US010494810B1

(12) United States Patent
Garunts et al.

(10) Patent No.: US 10,494,810 B1
(45) Date of Patent: Dec. 3, 2019

(54) MORTARLESS BUILDING BLOCKS WALL

(71) Applicants: Feliks Garunts, Van Nuys, CA (US); Samuel Garunts, Van Nuys, CA (US); Grigor Garunts, Van Nuys, CA (US)

(72) Inventors: Feliks Garunts, Van Nuys, CA (US); Samuel Garunts, Van Nuys, CA (US); Grigor Garunts, Van Nuys, CA (US)

(73) Assignees: Samuel Garunts, Van Nuys, CA (US); Grigor Garunts, Van Nuys, CA (US)

( * ) Notice: Subject to any disclaimer, the term of this patent is extended or adjusted under 35 U.S.C. 154(b) by 0 days.

(21) Appl. No.: 16/351,329

(22) Filed: Mar. 12, 2019

(51) Int. Cl.
*E04B 2/08* (2006.01)
*E04B 2/12* (2006.01)
*E04B 2/02* (2006.01)

(52) U.S. Cl.
CPC ..... *E04B 2/08* (2013.01); *E04B 2/12* (2013.01); *E04B 2002/021* (2013.01)

(58) Field of Classification Search
CPC ..... E04B 2/08; E04B 2/12; E04B 2002/021
See application file for complete search history.

(56) References Cited

U.S. PATENT DOCUMENTS

| | | | | |
|---|---|---|---|---|
| 468,838 | A | 2/1892 | Steiger | |
| 1,153,900 | A | 9/1915 | Fairbank | |
| 1,723,930 | A | 8/1929 | Giesler | |
| 2,844,022 | A | 7/1958 | Klem | |
| 2,911,818 | A | 11/1959 | Smith | |
| 2,932,745 | A * | 4/1960 | Gotting | E04B 1/92 250/517.1 |
| 3,238,680 | A | 3/1966 | Blair | |
| 3,269,070 | A | 8/1966 | Stoy | |
| 3,305,982 | A | 2/1967 | Steele | |
| 3,618,279 | A | 11/1971 | Sease | |
| 3,834,108 | A * | 9/1974 | Ludvigsen | E01C 5/00 52/592.6 |
| 4,429,506 | A | 2/1984 | Henderson | |
| 4,711,599 | A * | 12/1987 | Glickman | E01C 5/00 404/41 |
| 5,934,037 | A | 8/1999 | Bundra | |
| 7,871,223 | B2 | 1/2011 | MacDonald | |
| 8,800,236 | B2 | 8/2014 | Yong | |
| 9,183,957 | B2 | 11/2015 | Farrell | |
| 9,816,267 | B2 | 11/2017 | Farrell | |
| 2011/0146191 | A1 | 6/2011 | Farrell | |
| 2016/0024784 | A1 | 1/2016 | Farrell | |

* cited by examiner

*Primary Examiner* — Patrick J Maestri
(74) *Attorney, Agent, or Firm* — Phil IP Law Group; Narek Zohrabyan

(57) ABSTRACT

A wall constructed of building blocks designated as basic and modified, which have both convex and concave surface features. The convex and concave surface features are present both in the longitudinal and latitudinal direction. The convex and concave surface features are in parallel planes with one another. A curve in the wall is introduced with variation of these blocks with use of acute angle cutoff present on the latitudinal edge of the blocks. A curve in the wall can also be made with a bent on a block's longitudinal plane creating an obtuse angle at the outer longitudinal edge. The wall layers and ends are terminated by two types of filling blocks that are essentially one-half section of either the basic of modified block separated along the longitudinal direction or the latitudinal direction. The building blocks can also have a cavity used for filling in some compound.

20 Claims, 2 Drawing Sheets

MORTARLESS BUILDING BLOCKS WALL

BACKGROUND OF INVENTION

This invention relates to wall and other like structures where stability and resistance to shearing forces are required even in the absence of building materials such as mortar. The invention relates to wall construction using namely, clay, silica, concrete, or plastic blocks.

This construction is assembled using building blocks particularly configured for such use and its elements reside in a solid geometric form, which finds its basic application as a wall assembled of self-aligning building blocks. However, as will be apparent to an ordinary person skilled in the art, the geometric form of building blocks in a wall may be used in a wide variety of embodiments, some of which are more fully described hereinafter. The need for versatile building blocks which can be readily assembled by unskilled laborers has been recognized and several different types of interlocking building blocks have been proposed.

The use of a stepped configuration on the top of a conventional rectangular-shaped cinder block which matches with the bottom face of the succeeding block to be placed above the first block is disclosed by the Smith in U.S. Pat. No. 2,911,818. The upwardly extending projecting stepped surfaces are designed to hold succeeding courses of cinder block in position by means of this configuration.

Another type of interlocked block construction uses a square-shaped block mounted in a diamond configuration in a wall as shown by the Blair in U.S. Pat. No. 3,238,680. A "V" shaped groove construction is disclosed immediately adjacent to the front face of the block for providing an interlocking fit of adjacent blocks.

A retaining wall block, as described by MacDonald in U.S. Pat. No. 7,871,223 has parallel top and bottom faces, a front face, a rear face, first and second side wall faces and a vertical plane of symmetry extending between the front and rear faces. The block is formed as a body portion including the front face, a head portion including the rear face and a neck portion connecting the body portion and the head portion. The body, head and neck portions each extend between the top and bottom faces and between the first and second side wall faces. An opening extends through the neck portion from the top face to the bottom face, dividing the neck portion into first and second neck wall members extending rearward from the body portion to the head portion.

Another type of interlocking block construction used for buildings is disclosed by Steele in U.S. Pat. No. 3,305,982. In Steele, a combination of dove-tailed interlocking elements and an upwardly extending inter-fitted projection on the top face of each block is used.

Another type of interlocking construction block is disclosed by Hsien Ta Yong in U.S. Pat. No. 8,800,236 which shows opposed ends, each having a plurality of substantially planar bearing surfaces. The planar surfaces include perpendicular surfaces joined by surfaces at obtuse angles. The block is arranged to be complementary to other blocks in several different configurations.

Each of these constructions has been directed toward providing a simpler method of constructing buildings with blocks in which relatively unskilled labor could be employed to rapidly produce a satisfactory building. However, the previously proposed constructions have limitations, either with respect to ease of installation, ability to maintain a level course and curvature of a wall structure, and stability of the interlocked block construction. They are complicated, massive, heavy, prone to seismic shifts, and have minimal surface contact in order to maintain structural integrity.

In order to describe the present invention, an exemplary embodiment is set forth with particular references to building blocks of the type used in dry wall construction. This type of wall is widely used for outdoor applications such as for retaining walls, breakwaters, docks, sewage lagoon walls, cooling pond walls in the chemical industry, and the like. These walls are built without mortar or mortarless for various reasons including economy, ease of construction, and preferred appearance in landscaping applications.

It is an object of this invention to provide a structural element for use in the building of these structures that will result in a much stronger, integrated assemblage; particularly possessing high shear strength, both across and along the course.

It is a further object of this invention to provide a structural element suitable for the assembly of relatively massive structures where dimensional stability and high strength are required and where binding materials such as mortar cannot be used. The utility of the present invention can be extended into such fields as the construction of graphite reactor cores and concrete or lead shielding walls for use in nuclear reactors. In this case, as will be obvious, passageways for the insertion of fuel elements and control records may be provided at symmetric points in each structural element, as desired.

It is an object of the present invention to provide wall building blocks having shaped bodies suitable for interlocking with the faces of other similar blocks.

It is a further object of the present invention to facilitate the assembly of structures by arranging a plurality of such blocks in layers or in courses, where structures are fully interlocked in all directions in the plane of the bodies.

It is another object of the present invention to provide curved wall construction using the building blocks.

It is a further object of the present invention to provide a building block of self-aligning construction having right angle turns, more surface contact areas, and being adapted to fully interlock with other similar blocks in a wall structure maintaining a complete structure.

It is a further object of the present invention to provide a hollow building block that has a cavity which can be filled with liquids, semisolid liquids, or waste, where needed. These blocks are easily transportable when empty and are easy to fill and build a wall with.

The form of these blocks come in four types of modular units.

The first type of block is called a "basic block". The basic block is made of two polygonal volumes that are integrated together longitudinally or latitudinally. This integrated unit forms two pairs of convex and concave formations with a top and a bottom surface. The angle created on the top surface in the longitudinal plane measures >180° but <270° and the angle created on the top surface in the latitudinal plane measure <180° but >90°; and the angle created on the bottom surface in the longitudinal plane measure <180° but >90° and the angle created on the bottom surface in the latitudinal plane measure >180° but <270°.

The second type of block is called a "modified block". The modified block is made of two polygonal volumes that are integrated together longitudinally or latitudinally. This integrated unit forms two pairs of convex and concave formations with a top and a bottom surface. The angle created on the top surface in the longitudinal plane measures <180° but >90° and the angle created on the top surface in the latitudinal plane measure <180° but >90°; and the angle created on the bottom surface in the longitudinal plane measure >180° but <270° and the angle created on the bottom surface in the latitudinal plane measure >180° but <270°.

The third type of block is called an "acute angle block". The acute angle block has an acute angle cut off on the latitudinal edge of the block. The acute angle cut off can appear on either latitudinal edge of a block.

The fourth type of block is called an "obtuse angle block". The obtuse angle block has a concave shape on its latitudinal plane. As a variation of the obtuse angle block, an acute angle cut off can appear on either latitudinal edge of the block.

The different types of building blocks are made of polygonal volumes that have pairs of surface sections running on parallel planes to one another. The set of surface sections make surface formations that are either concave or convex, spanning in the longitudinal or latitidunial direction. The concave surface formations and the convex surface formations are bent at their mid-lines, forming a pair of two symmetric surface partials. The building blocks can also have a cavity that is used to fill with liquid or semiliquid compounds. The building block can also have a cap to secure the contents.

SUMMARY OF INVENTION

Accordingly, it is a principal feature of this invention to provide a wall having new, mortarless, concrete, and self-aligning block construction.

It is a further feature of this invention to provide a self-aligning block which can be more easily used by unskilled labor and to more rapidly assemble a wall.

A still further feature of this invention is to provide a self-aligning block construction which can be very quickly installed into a locked position with an accurate fit. After which, the block construction provides more strength than previous types of constructions.

Another feature of this invention is to provide a building block which is self-leveling.

It is a further feature of this invention to provide a building block configuration usable with different specialized block constructions such as for corners, doors, and windows.

It is still a further feature of this invention to provide specialized types of self-supporting, self-aligning blocks which will facilitate the assembly of a firm and compact structure without requiring mortar or reinforcing elements. The proposed structure increases integrity of the wall at times of seismic activity without the use of mortar high marks, and special reinforcing mesh height masonry. With the construction of temporary light structures, it provides stability without the use of masonry mortar.

According to this invention, each building block is formed as a single unit having pairs of convex and concave sections.

In the case of the convex pair, the convex sections are connected together on the longitudinal midline such that the pair of the convex sections as a whole makes two concave surfaces. This is illustrated in FIG. 2, with the pair of convex sections running the longitudinal length from (7) to (9) and the other section running the longitudinal length from (8) to (10). When these pairs are joined in the longitudinal midline, two concave surfaces emerge running through the latitudinal line from (7) to (8) and (9) to (10).

In the case of the concave pair, the concave sections are connected together on the longitudinal midline such that the pair of the concave sections itself makes two convex surfaces. This is illustrated in FIG. 2A, with the pair of concave sections running the longitudinal length from (8*a*) to (10*a*) and the other section running the longitudinal length from (7*a*) to (9*a*). When these pairs are joined in the longitudinal midline, two convex surfaces emerge running through the latitudinal line from (8*a*) to (7*a*) and (10*a*) to (11*a*).

In order to create a curved part of the wall, there are different building blocks which are used. These building blocks have an acute angle cut off at the latitudinal edge of either side of the convex or concave pair sections. The acute angle can be on one side or on both sides of the building block. This is illustrated in FIGS. 6, 6A, and 7A. Specifically, in FIG. 6, the additional section, (12*b*), is shown protruding from the latitudinal line going from (7*b*) to (8*b*) which makes the acute angle.

Yet another way of creating a curved wall, based on the desired curvature of the wall, is to use building blocks that have a concave shape given to its latitudinal plane, which creates an obtuse angle. This is illustrated in FIG. 7A where a top down view of such a building block shows an obtuse angle created between sections (8) and (10) on the latitudinal plane.

Another type of building block is contemplated to have a hollow interior. This type of block has a cavity inside it which allows a builder to fill it up with other materials such as cement, clay, sand, water, liquids, waste or the like. This building block has a hole on its surface which can be covered up by a cap or latch which secures it shut, not allowing the contents to spill out. The cap or latch can use a locking mechanism or can be made to function as an Archimedean screw that tightens as it is turned one way and loosens as it is turned the other way. This cap or latch sits flush with the outer surface of the building block, allowing for other building blocks to be installed on top if one another. This variation is better illustrated in FIGS. 9 and 9A.

The invention will be further described by reference to the accompanying drawings wherein:

FIG. 8 (*d*1) is a top-down view of the building block structure created in FIG. 8(*d*);

DETAILED DESCRIPTION OF THE DRAWING

Figure 1:
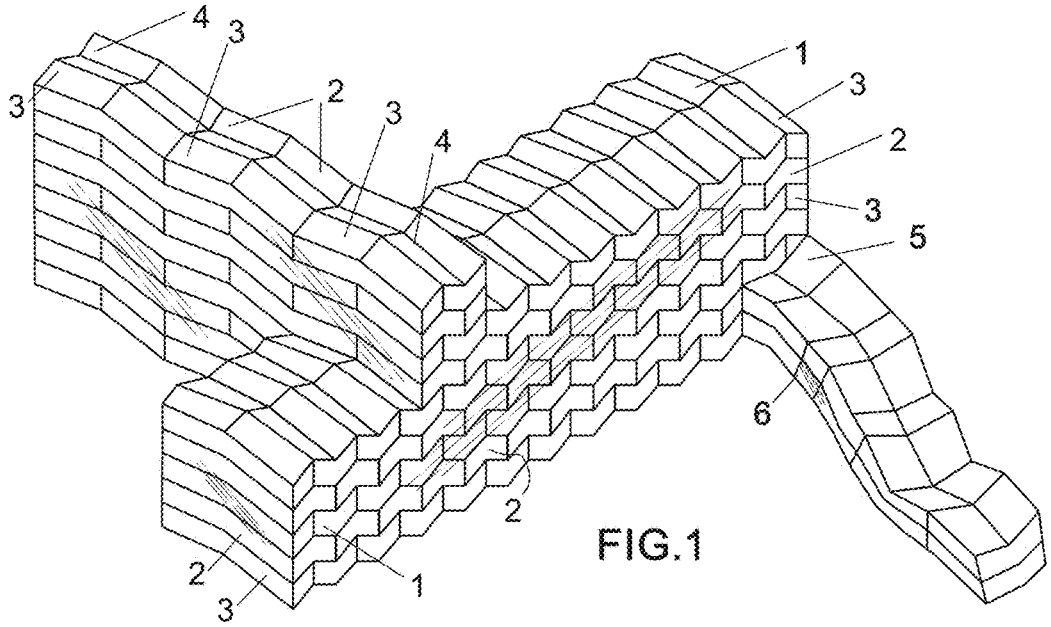
FIG. 1 is a perspective view of a wall construction assembled with the different types of the modular building blocks.

Referring to FIG. 1, a wall is constructed using some of the various building blocks discussed above. For example, one type of building block (1) is better described and illustrated below under FIG. 2. This building block (1) is a complete unit generally resembling a convex shape on its longitudinal direction and specifically showing, within it, two concave shapes on its latitudinal direction A modified version of the building block (2) is also shown throughout the wall construction that is better discussed and illustrated below under FIG. 3. This building block forming the top and bottom layers therein. Another building block, which is a polygonal volume that is one-half longitudinal section (3) of a complete building block (1) that is better discussed and illustrated under FIG. 4. Yet another type of building block, which is a polygonal volume that is a one-half latitudinal section (4) of a complete building block (2) that is better discussed and illustrated below under FIG. 5. This type of block is utilized at the ends of the wall. Final variations of the building blocks, which give the wall its curvature, are shown by (5) and (6). The acute angle cut-off building block (5) is better discussed and illustrated below under FIG. 6. The obtuse angled building block (6) that is shown to be "bent" inwards at its latitudinal plane is better discussed and illustrated below under FIG. 7.

Figure 2:
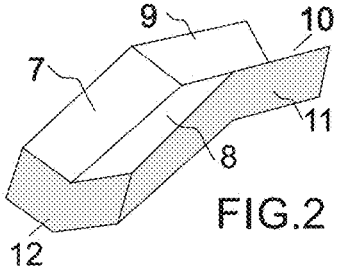
FIG. 2 is a perspective view of the basic building block which is composed of two convex polygonal volumes such that the convex sections are connected together on the longitudinal midline where the pair of the convex polygonal volumes as a whole make two concave surfaces.

Referring to FIG. 2, is a basic building block having two convex pair sections (7) to (9) and (8) to (10). These sections are combined in the longitudinal direction (not referenced) such that the convex sections (7, 9) and (8, 10) are connected together on the longitudinal midline where the pair of the convex sections as a whole make two concave surfaces (7, 8) and (9, 10). The longitudinal edge of this block is shown in (11) and the latitudinal edge is shown in (12). The angle created on the longitudinal plane, measures >180° but <270°. The angle created by latitudinal plane measures <180° but >90°.

Figure 2A:
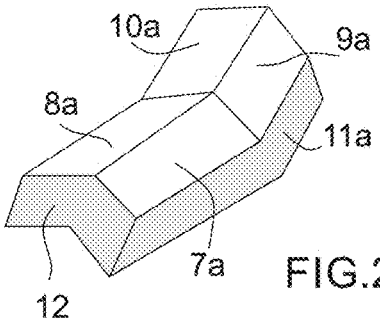
FIG. 2A is an upside-down perspective view of the basic building block.

Referring to FIG. 2A, is the same basic building block discussed above in FIG. 2 except here it is shown upside-down. This block is showing concave pair sections (8*a*, 10*a*) and (7*a*, 9*a*) connected together on the longitudinal direction (not referenced) on the longitudinal midline. The connected concave pair sections as a whole make up two convex surfaces (8*a*) to (7*a*) and (10*a*) to (11*a*) on the latitudinal direction (not referenced) but shown on the latitudinal line. The longitudinal edge of this block is shown in (11*a*) and the latitudinal edge is shown in (12).

Figure 3:
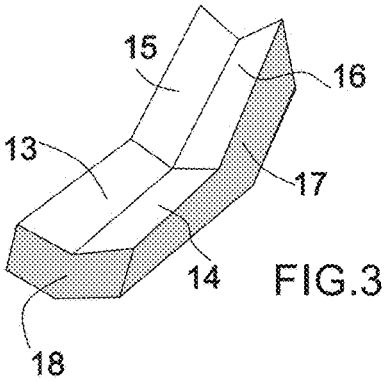
FIG. 3 is a perspective view of the modified building block. This block is essentially made of concave pair sections where the concave sections are connected together on the longitudinal midline such that the pair of the concave polygonal volumes as a whole make two concave surfaces.

Referring to FIG. 3, is a modified building block. The modified building block is made of a pair of concave sections (13) to (15) and (14) to (16). Where the concave sections are connected together on the longitudinal direction (not referenced) along the longitudinal midline such that the combination as a whole makes two concave surfaces (13, 14) and (15, 16) along the latitudinal direction (not referenced). The longitudinal edge of this block is shown in (17) and the latitudinal edge is shown in (18). The angle created on the longitudinal plane measures >90° but <180°. The angle created on the latitudinal plane measures >90° but <180°.

Figure 3A:
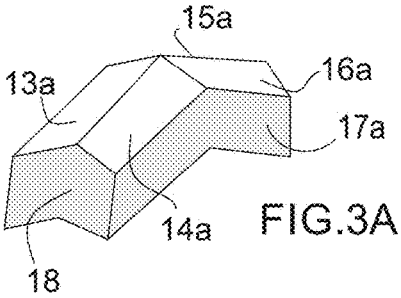
FIG. 3A is an upside-down perspective view of the modified building block.

Referring to FIG. 3A, is the same modified building block discussed above in FIG. 3 except here it is shown upside-down. The upside-down view shows the modified building block with a pair of convex sections (13*a*) to (15*a*) and (14*a*) to (16*a*). Where the convex sections are connected together on the longitudinal direction (not referenced) along the longitudinal midline such that the combination as a whole makes two convex surfaces (13*a*, 14*a*) and (15*a*, 16*a*) along the latitudinal direction (not referenced). The longitudinal edge of this block is shown in (17*a*) and the latitudinal edge is shown in (18).

Figure 4:
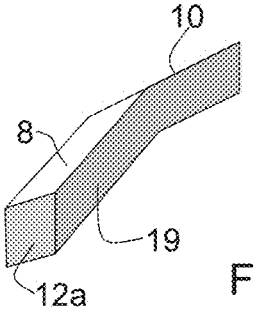
FIG. 4 shows a polygonal volume that is one-half section of a whole building block, which shows a convex surface shape running from the longitudinal line (8) to (10) according to the present invention. This is essentially one-half section of FIG. 2.

Referring to FIG. 4, is a longitudinal one-half section of the building block in FIG. 2 which is regarded as a polygonal volume. The longitudinal one-half section shows one section of the pair from (8) to (10). The midline longitudinal edge (19) is depicted as a shaded surface. One-half of the latitudinal section (12*a*) is also depicted as a shaded surface.

Figure 5:
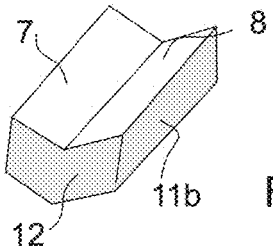
FIG. 5 shows a polygonal volume that is one-half of a building block taken from its latitudinal line running from (7) to (8). This is essentially one-half of the building block shown in FIG. 2 according to the present invention.

Referring to FIG. 5, is a one-half section of the building block in FIG. 2 which is regarded as a polygonal volume. The one-half section is taken from its latitudinal midline line (note referenced) running from (7) to (8). One complete latitudinal edge (12) is depicted but only one-half of the longitudinal section (11*b*) is present for this type of a building block.

Figure 6:
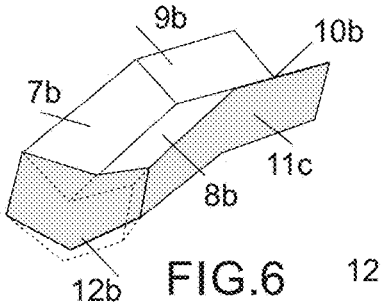
FIG. 6 is a perspective view of the third type of building block that has an angel addition (12*b*) on one edge, which is used to make curved wall structures. Not shown here, but the (12*b*) addition could also be an acute angle cut-off from the edge as depicted in FIG. 7A.

Referring to FIG. 6, is a variation of the basic building block discussed above under FIG. 2. However, this variation has an acute angle section addition (12*b*) that is cut off from along one of the latitudinal edges. The same type of an acute angle cutoff can be effectuated on both sides of the building block. The acute angle cut-off (12*b*) allows the building block to be stacked in various combinations in order to give the wall curvature. The longitudinal edge is depicted here as (11*c*) and the longitudinal pair sections are shown by (7*b*, 9*b*) and (8*b*, 10*b*).

Figure 7:
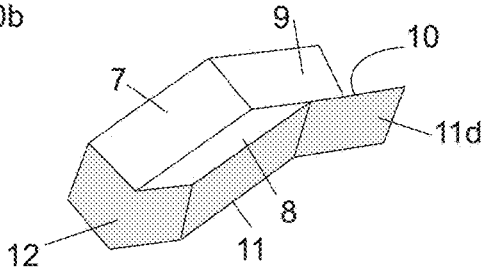
FIG. 7 shows a perspective view of the fourth type of building block used to construct a curved wall structure. This type of building block has a concave shape given to its latitudinal plane, which creates an obtuse angle.

Referring to FIG. 7, is another building block. Here however, the building block makes an obtuse angle between one partial of the longitudinal pair (11) and (11*d*) such that the building block is concaved on its longitudinal plane. The longitudinal pair sections are shown by (7, 9) and (8, 10) and one latitudinal edge is shown in (12).

Figure 7A:
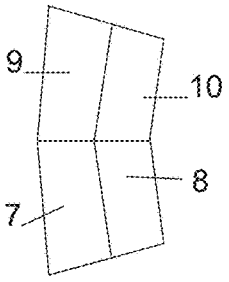
FIG. 7A is a top-down view of a combination of the third and fourth type of building block that is used to construct a curved wall. This building block incorporates both an acute cutoff angle on its edge on the latitudinal plane as well as a concave shape given on its latitudinal plane creating an obtuse angler.
Figure 6A:
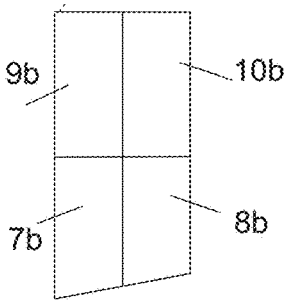
FIG. 6A is a top-down view of the third type of building block that has an acute angle cut-off from its edge on the latitudinal plane which is used to make curved wall structures.

Referring to FIG. 7A, is a top down view of a combination block that includes an angle cut-off as well as an obtuse angle on its longitudinal plane. The building block makes an obtuse angle between the longitudinal pairs (7, 9) and (8, 10) such that the building block is concaved on its longitudinal plane. Furthermore, this block is also depicted with acute angle cut-offs on each side of its latitudinal edge (12*c*) and (12*d*).

Figure 8:
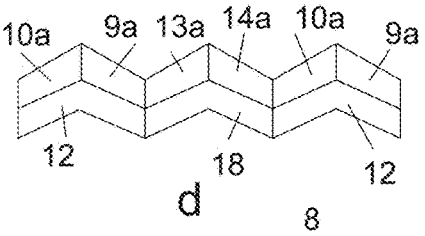
FIG. 8 (*a, b, c*, and *d*) shows the partial front view of some building blocks configured in some pattern, stacked on top of each other.
Figure 8:
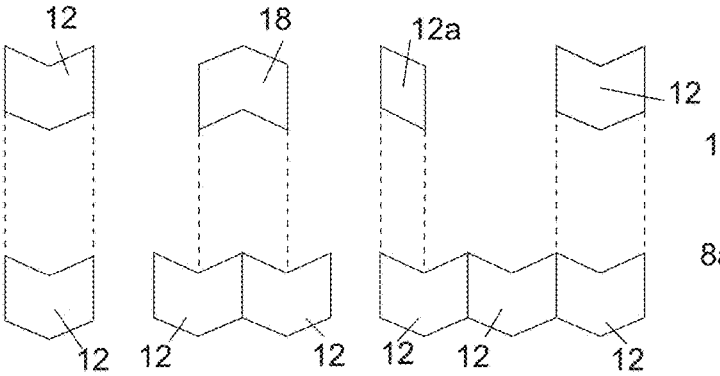

Referring to FIG. 8(*a*) is a partial front-view of the building block discussed in FIG. 2. The latitudinal edge (12) is shown and two of these building blocks are stacked one on top of each other.

Referring to FIG. 8(*b*) is a partial front-view of the building blocks discussed in FIG. 2 that are set side by side. The building blocks (12) are assembled together by stacking another building block (18) as discussed in FIG. 3A.

Referring to FIG. 8(*c*) is a partial front-view of the building blocks discussed in FIG. 2 and FIG. 4 stacked in a certain combination. For example, three of the building blocks (12) are set side by side. One of the building blocks (12) has another building block (12), possibly the type discussed in FIG. 5, stacked on top of it. One of the other building blocks (12) has a building block (12*a*) stacked on top of it, most likely a building block shown in FIG. 4.

Referring to FIG. 8(*d*) is a partial front-view of the building blocks discussed in FIG. 2A and FIG. 3A stacked in a certain combination. For example, here, only one layer of blocks are put side by side where the middle block is somewhat offset. One of the building blocks as shown in FIG. 2A shows its latitudinal edge (12) and partial top surfaces (10*a*) and (9*a*). Next to this block and offset longitudinally is block FIG. 3A, as discussed above, shown by its latitudinal edge (18) and its partial top surfaces (13*a*) and (14*a*). Finally, the combination is terminated with another block discussed under FIG. 2A.

Referring to FIG. 8(*d*1) is a top-down view of the FIG. 8(*d*) as discussed above. Here, the middle block, FIG. 3A (showing surfaces 13*a*, 14*a*, 15*a*, 16*a*) is seen offset and sandwiched in between two FIG. 2A blocks (showing surfaces 7*a*, 8*a*, 9*a*, 10*a*).

Figure 9:
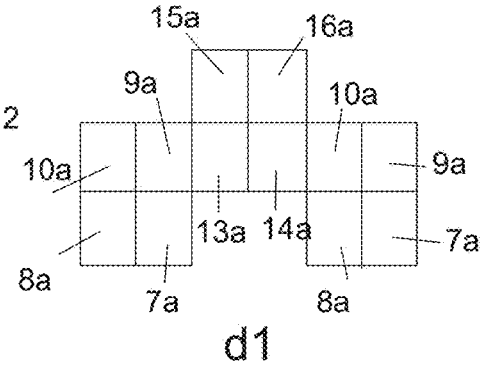
FIG. 9 shows lengthwise cross-section of a hollow building block where the opening of the block is shown in (20)
Figure 9:
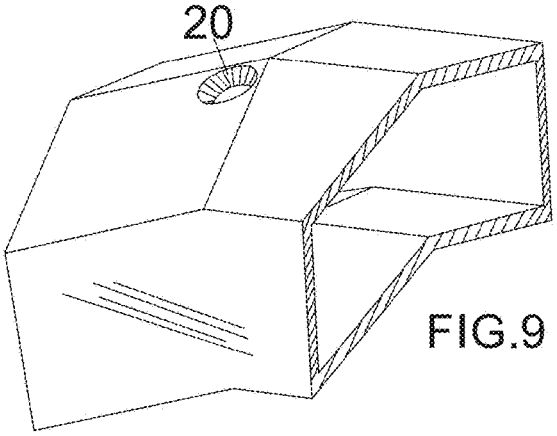
Figure 9A:
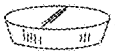
FIG. 9A shows the cap or screw that is installed unto the hollow block to secure its contents.

Referring to FIG. 9, is the basic building block as described above with a hollow cavity and an opening (20) to allow the filling of the cavity with any material of choice such as sand, liquids, and other building materials. The opening can be sealed using a fitted cap (FIG. 9A).

The invention claimed to:

1. A mortarless building block for constructing a wall comprising:

a plurality of polygonal volumes;

wherein each of the polygonal volumes has at least one pair of surface sections running on parallel planes to one another;

one set of surface sections forms a concave surface formation when it is bent at the midline and another set of surface sections forms a convex surface formation when it is bent at the midline;

and wherein the combination of the concave surface formation and the convex surface formation spans in a longitudinal direction or in a latitudinal direction.

2. The mortarless building block of claim 1, wherein a basic building block comprises:

the plurality of polygonals made of two combinations of the concave surface formations and the convex surface formations, integrated as a single unit either on the longitudinal direction or in the latitudinal direction;

the integrated unit forms another two combinations of convex and concave surface formations;

the basic building block includes a top surface and a bottom surface;

a first angle created on the top surface in the longitudinal plane measures >180° but <270° and a second angle created on the top surface in the latitudinal plane measures <180° but >90°; and a third angle created on the bottom surface in the longitudinal plane measures <180° but >90° and a fourth angle created on the bottom surface in the latitudinal plane measures >180° but <270°.

3. The mortarless building block of claim 1, wherein a modified building block comprises:

the plurality of polygonal volumes made of two combinations of the concave surface formations and the convex surface formations, integrated as a single unit on the longitudinal direction or in the latitudinal direction;

the integrated unit forms another two combinations of convex and concave surface formations;

the modified building block includes a top surface and a bottom surface;

a first angle created on the top surface in the longitudinal plane measures <180° but >90° and a second angle created on the top surface in the latitudinal plane measures <180° but >90°; and a third angle created on the bottom surface in the longitudinal plane measures >180° but <270° and a fourth angle created on the bottom surface in the latitudinal plane measures >180° but <270°.

4. The mortarless building block of claim 2, wherein the basic building block has an acute angle cut off on either side of the basic building block's edge surface, located on the basic building block's latitudinal plane.

5. The mortarless building block of claim 2, wherein the basic building block is bent inwardly on the basic building block's longitudinal plane, at its midline, resulting into an obtuse angle on an edge surface located on the basic building block's longitudinal plane.

6. The mortarless building block of claim 2, wherein:

the basic block has an acute angle cut off on either side of the basic building block's edge surface, located on the basic building block's latitudinal plane; and is bent inwardly on the basic building block's longitudinal plane, at its midline, resulting into an obtuse angle on an edge surface located on the basic building block's longitudinal plane.

7. The mortarless building block of claim 3, wherein the modified building block has an acute angle cut off on either side of the modified building block's edge surface, located on the modified building block's latitudinal plane.

8. The mortarless building block of claim 3, wherein the modified building block is bent inwardly on the modified building block's longitudinal plane, at its midline, resulting into an obtuse angle on an edge surface located on the modified building block's longitudinal plane.

9. The mortarless building block of claim 3, wherein:

the modified building block has an acute angle cut off on either side of the modified building block's edge surface, located on the modified building block's latitudinal plane; and is bent inwardly on the modified building block's longitudinal plane, at its midline, resulting into an obtuse angle on an edge surface located on the modified building block's longitudinal plane.

10. A wall constructed with mortarless building blocks comprising:

a multiple of polygonal volumes;

wherein the polygonal volumes have at least one pair of surface sections running on parallel planes to one another;

one set of surface sections forms a concave surface formation when it is bent at the midline and another set of surface section forms a convex surface formation when it is bent at the midline;

wherein the combination of the concave surface formation and the convex surface formation spans in a longitudinal direction or in a latitudinal direction;

wherein the wall has a combination of basic building blocks and modified building blocks;

the basic building block is a block that includes some of the polygonal volumes with two combinations of the concave surface formations and the convex surface formations, integrated as a single unit either on the longitudinal direction or in the latitudinal direction;

the integrated unit forms another two combinations of convex and concave surface formations;

the basic building block includes a top surface and a bottom surface;

a first angle created on the top surface in the longitudinal plane measures >180° but <270° and a second angle created on the top surface in the latitudinal plane measures <180° but >90°;

a third angle created on the bottom surface in the longitudinal plane measures <180° but >90° and a fourth angle created on the bottom surface in the latitudinal plane measures >180° but <270°;

the modified building block is a block that includes some of the polygonal volumes with two combinations of the concave surface formations and the convex surface formations, integrated as a single unit either on the longitudinal direction or in the latitudinal direction;

the integrated unit forms another two combinations of convex and concave surface formations;

the modified building block has a top surface and a bottom surface;

a fifth angle created on the top surface in the longitudinal plane measures <180° but >90° and a sixth angle created on the top surface in the latitudinal plane measures <180° but >90°; and a seventh created on the bottom surface in the longitudinal plane measures >180° but <270° and an eighth angle created on the bottom surface in the latitudinal plane measures >180° but <270°.

11. The wall of claim 10, wherein either the basic building block or the modified building block has an acute angle cut off on either side of either building block's edge surface, located on either building block's latitudinal plane.

12. The wall of claim 10, wherein either the basic building block or the modified building block is bent inwardly on either building block's longitudinal plane, at their respective midlines, resulting into an obtuse angle on an edge surface located on either building block's longitudinal plane.

13. The wall of claim 10, wherein:

either the basic building block or the modified building block has an acute angle cut off on either side of either building block's edge surface, located on either building block's latitudinal plane; and is bent inwardly on either building block's longitudinal plane, at their respective midlines, resulting into an obtuse angle on an edge surface located on either building block's longitudinal plane.

14. A wall constructed with mortarless building blocks comprising:

at least four polygonal volumes, one pair integrated as a single unit to construct a basic building block and another pair integrated as a single unit to construct a modified building block;

the basic building block is a block that includes the polygonal volumes with two combinations of a concave surface formation and a convex surface formation, integrated as a single unit either on a longitudinal direction or in a latitudinal direction;

the integrated unit forms another two combinations of convex and concave surface formations;

the basic building block includes a top surface and a bottom surface;

a first angle created on the top surface in the longitudinal plane measures >180° but <270° and a second angle created on the top surface in the latitudinal plane measures <180° but >90°;

a third angle created on the bottom surface in the longitudinal plane measures <180° but >90° and a fourth angle created on the bottom surface in the latitudinal plane measures >180° but <270°;

the modified building block is a block that includes the polygonal volumes with two combinations of the concave surface formations and the convex surface formations, integrated as a single unit either on the longitudinal direction or in the latitudinal direction;

the integrated unit forms another two combinations of convex and concave surface formations;

the modified building block includes a top surface and a bottom surface;

a fifth angle created on the top surface in the longitudinal plane measures <180° but >90° and a sixth angle created on the top surface in the latitudinal plane measures <180° but >90°; and a seventh angle created on the bottom surface in the longitudinal plane measures >180° but <270° and an eighth angle created on the bottom surface in the latitudinal plane measures >180° but <270°.

15. The wall of claim 14, wherein the basic building block and the modified building block has an acute angle cut off on either side of both building block's edge surface, located on both building block's latitudinal plane.

16. The wall of claim 14, wherein the basic building block and the modified building block is bent inwardly on both building block's longitudinal plane, at their respective midlines, resulting into an obtuse angle on an edge surface located on both building block's longitudinal plane.

17. The wall of claim 14, wherein:

the basic building block and the modified building block has an acute angle cut off on either side of both building block's edge surface, located on both building block's latitudinal plane; and is bent inwardly on both building block's longitudinal plane, at their respective midlines, resulting into an obtuse angle on an edge surface located on both building block's longitudinal plane.

18. The mortarless building block of claim 2, wherein:

the basic building block has a cavity;

the basic building block has at least one opening on a surface allowing access to the cavity; and the basic building block can have at least one cap or latch to close the opening of the cavity.

19. The mortarless building block of claim 3, wherein:

the modified building block has a cavity;

the modified building block has at least one opening on a surface allowing access to the cavity; and the modified building block can have at least one cap or latch to close the opening of the cavity.

20. The wall of claim 10, wherein:

the basic building block or the modified building block has a cavity;

the basic building block or the modified building block has at least one opening on a surface allowing access to the cavity; and the basic building block or the modified building block can have at least one cap or latch to close the opening of the cavity.

* * * * *